United States Patent [19]

Wood

[11] 4,416,229

[45] Nov. 22, 1983

[54] FUEL INJECTION SYSTEM FOR DIESEL ENGINES

[75] Inventor: Charles D. Wood, San Antonio, Tex.

[73] Assignee: Southwest Research Institute, San Antonio, Tex.

[21] Appl. No.: 278,653

[22] Filed: Jun. 29, 1981

[51] Int. Cl.[3] ..... F02M 43/00

[52] U.S. Cl. ..... 123/304; 123/445; 239/423; 239/533.2

[58] Field of Search ..... 123/304, 445, 446; 239/410, 409, 423, 533.2–533.11

[56] References Cited

U.S. PATENT DOCUMENTS

| | | | |
|---|---|---|---|
| 1,419,231 | 6/1922 | Crossley et al. | 123/304 |
| 1,788,703 | 1/1931 | Bushnell | 239/409 |
| 1,857,256 | 5/1932 | Nordberg | 123/304 |
| 2,090,781 | 8/1937 | Camner | 123/446 |
| 2,697,007 | 12/1954 | Wille | 239/410 |
| 3,933,132 | 1/1976 | Kishishita | 123/445 |

FOREIGN PATENT DOCUMENTS

| | | | |
|---|---|---|---|
| 2908375 | 9/1980 | Fed. Rep. of Germany | 123/304 |

*Primary Examiner*—Charles J. Myhre
*Assistant Examiner*—Andrew M. Dolinar
*Attorney, Agent, or Firm*—Vaden, Eickenroht, Thompson, Bednar & Jamison

[57] ABSTRACT

A fuel injection system for a diesel engine is disclosed as having a single injector for injecting diesel fuel and alternative fuel into each combustion chamber of the engine in the form of a plume having diesel fuel at its tip so that the diesel fuel is ignited by the compression in the chamber and the alternative fuel is ignited by the ignition of the diesel fuel.

6 Claims, 4 Drawing Figures

Figure 2:
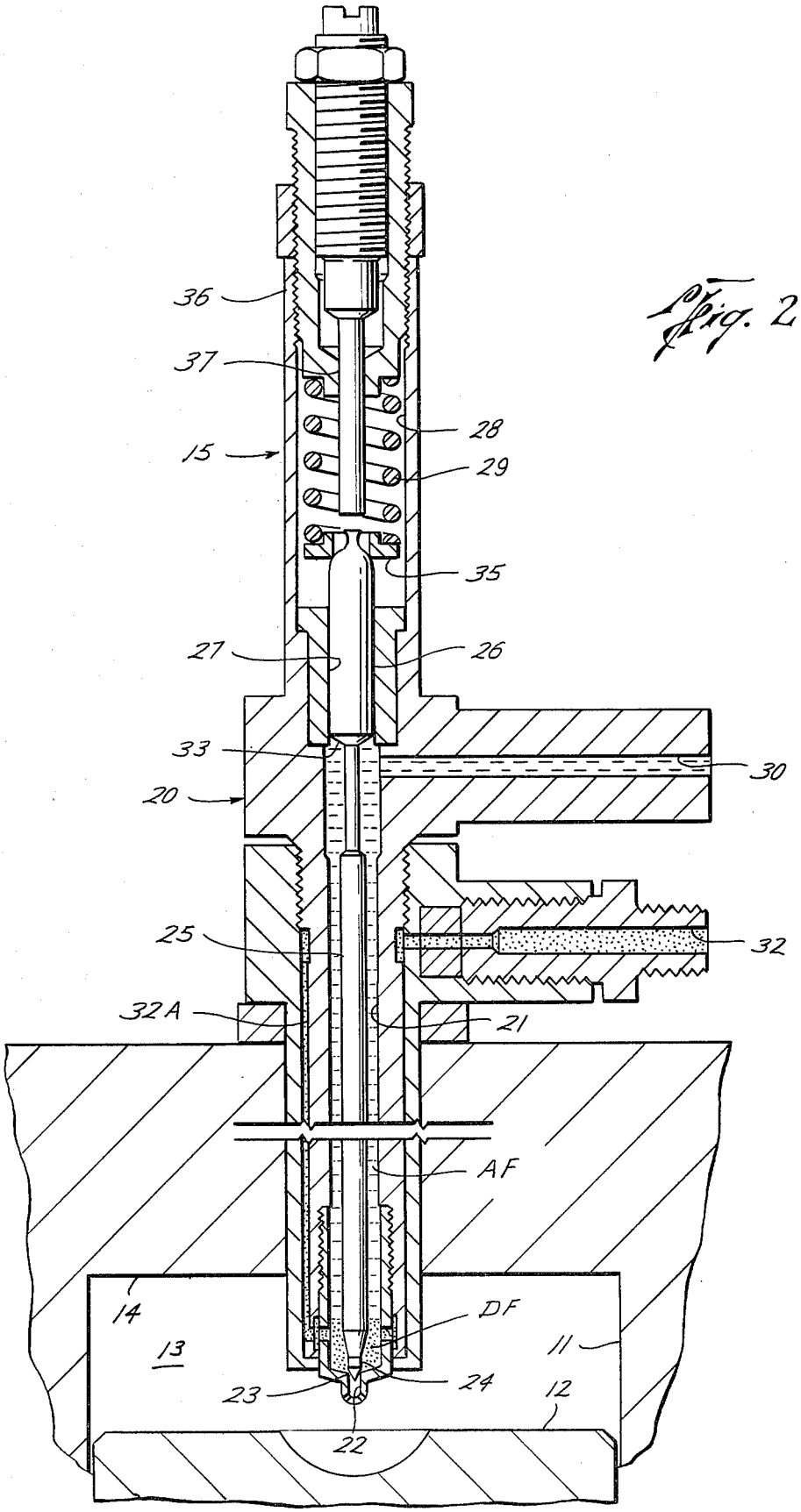

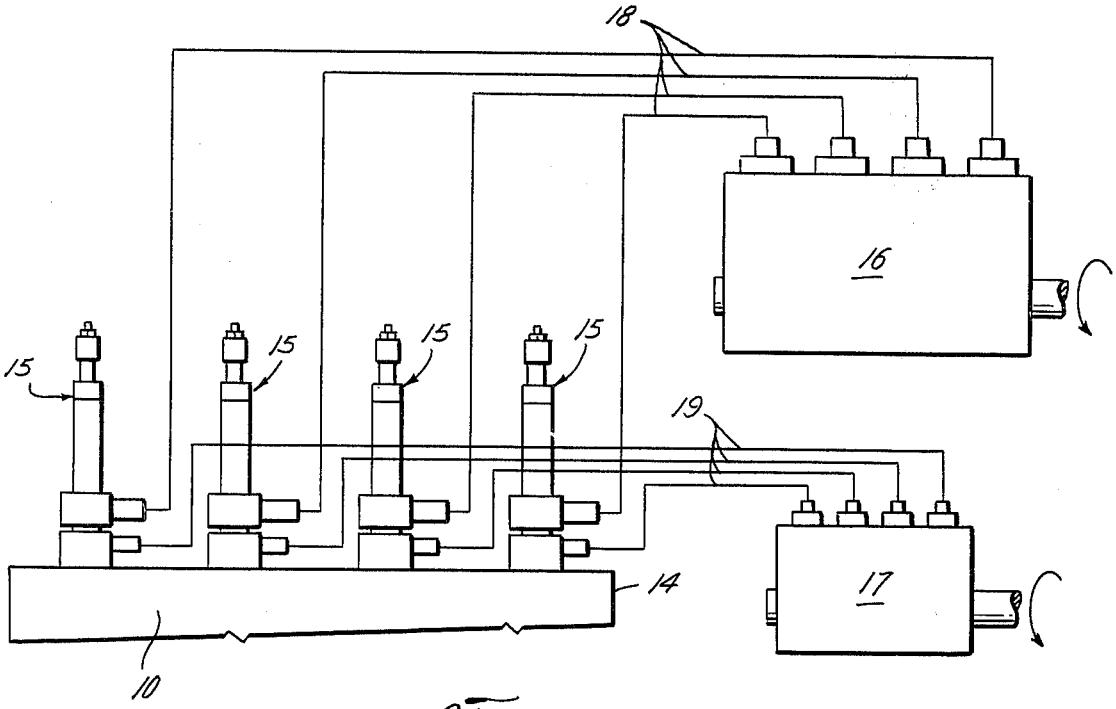
Fig. 1
Fig. 3
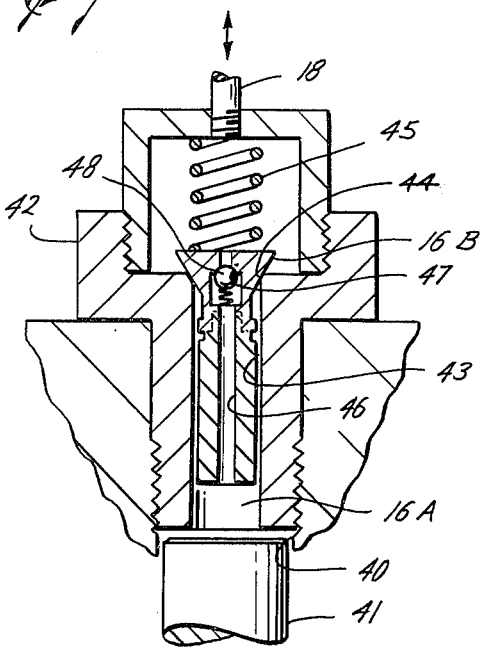
Fig. 4
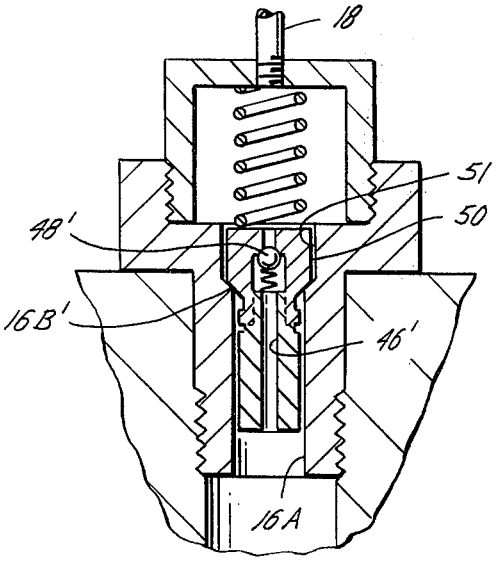

FUEL INJECTION SYSTEM FOR DIESEL ENGINES

This invention relates generally to fuel injection systems for diesel engines. More particularly, it relates to improvements in such systems wherein the engine is operated in a "dual fuel" mode—i.e., with a combination of diesel fuel and an alternative fuel.

Due to the depleting supply of diesel fuel, efforts have been made to operate diesel engines with a combination of diesel fuel and an alternative fuel in greater supply. However, many such alternative fuels have low cetane numbers, and are thus particularly unsuitable for compression ignition. For example, in the case of high speed diesel engines, cetane numbers less than 35 are considered low, and, in the case of low speed diesel engines, cetane numbers less than 25 are considered low. Methanol and ethanol, which are well known alternative fuels, have a zero cetane number, and other alternative fuels, such as liquid fuels derived from coal, often have cetane numbers less than 15.

Hence, it has been proposed to supply both fuels to the combustion chamber of each cylinder in such a manner that, during the compression stroke of the piston within the cylinder, the diesel fuel is first ignited and the alternative fuel is in turn ignited by the diesel fuel. For example, a pilot charge of diesel fuel may be injected into the combustion chamber, and an alternative fuel, either in liquid or gas form, may be premixed with the combustion air in the combustion air in the intake manifold, or the diesel fuel and a liquid alternative fuel may be premixed and the mixture injected directly into the combustion chambers. However, for various reasons, it has not been found possible in either case to replace more than about 50% of the diesel fuel with alternative fuel.

These problems may be overcome to the extent that the useable amount of alternative fuel may be increased considerably by injecting each fuel into the combustion chamber through individual injectors. However, in small engines, such as those used for automotive purposes, there is very little space in the cylinder head to receive two injectors. Furthermore, it would be necessary to drastically modify the cylinder heads of existing larger engines to receive two injectors. Still further, the injection of both fuels through individual injectors may produce a fuel distribution pattern which is not altogether satisfactory.

It is therefore the object of this invention to provide a "dual fuel" injection system which obviates the disadvantages of those first described in that it enables the engine to be operated with a large percentage of alternative fuel, and which further obviates those of the last described system in that it is of such construction that it is usable with small engines and, in the case of large engines, requires a minimum of alteration of the cylinder head, and further, in either case, produces a more satisfactory fuel distribution pattern.

This and other objects are accomplished, in accordance with the illustrated embodiments of the invention, by a system in which both diesel fuel and a liquid alternative fuel may be injected through a single injector connecting with the combustion chamber of each cylinder of the engine. Thus, as compared with other systems wherein the alternative fuel is premixed with combustion air in the intake manifold or with the diesel fuel, larger amounts of alternative fuel, and even up to as much as 95% by weight of the total fuel, may be used in operating the engine. At the same time, the single injector requires substantially no more room that that used to inject only diesel fuel, in the case of conventional systems operating on diesel fuel alone, and is thus readily installable on the cylinder heads of small engines. Further, the single injector requires a minimum amount of retrofitting of the cylinder heads of large engines, similarly equipped with conventional systems, and may be so arranged in the head as to inject the fuels centrally of the combustion chambers, rather than in side-by-side relation as in the case of dual injectors, and thus in a way to provide a better fuel distribution pattern.

Each injector is similar to existing injectors for diesel fuel alone in that is includes a cavity having a port through which fuel may be injected into the combustion chamber and a valve seat about the port. Also, a valve member is shiftable within the cavity between one position on the seat to close the port and another position spaced from the seat to open the port, and means are provided for urging the valve member toward closed position with a force which is independent of the pressure of fuel within the cavity, and for urging it to open position in response to fuel pressure in the cavity which is sufficiently high to overcome the force which normally maintains it closed. More particularly, an injection pump is provided to supply fuel to the cavity at such pressure as to move the valve member to open position at intervals just prior to movement of the piston of the cylinder of the chamber into which the fuel is to be injected into high center position during its compression stroke, and conduits which connect each pump chamber to each cavity are controlled by check valves for preventing back flow of fuel through the conduits in order to maintain the cavities filled intermediate injection events.

In accordance with the present invention, however, a liquid alternative fuel, rather than the diesel fuel, is pumped intermittently into the injector cavities so as to open the ports in the injectors at the desired intervals, and means including check valve controlled conduits are provided for supplying the diesel fuel to the cavity of each injector at a location near the valve seat and at a relatively low pressure which is not sufficient to move the valve member to open position. More particularly, the diesel fuel is supplied to each cavity prior to the intermittent supply thereto of alternative fuel, either intermittently through an injection pump, as in the case of the alternative fuel, or from a source at constant pressure, and a means is provided through which alternative fuel may bypass the check valves in the means by which it is supplied to the injector cavities as it is displaced by the supply of diesel fuel. When the injection ports are opened by the supply of alternative fuel to the injector cavities, during injection events, a plume of both fuels having diesel fuel at its tip is injected into each combustion chamber to enable the diesel fuel to be ignited by the compression in the chamber and the alternative fuel to be ignited by the diesel fuel. In the illustrated embodiment of the invention, the means which permits alternative fuel to bypass the check valve in the fuel supplying means comprises a bypass passage, which may be formed in the check valve itself, and which is normally closed by a check valve adapted to open only as alternative fuel is displaced in the injector cavity by diesel fuel.

In the illustrated embodiment of the injector itself, the fuel cavity is formed within and extends longitudinally of a body which is adapted to be connected to the cylinder head, with the injection port formed in one end of the body so as to connect the cavity with the combustion chamber when the body is so connected to the cylinder head. More particularly, a rod is mounted for guided reciprocation within the body, and the valve member is carried by the rod to engage with the seat in order to close the port, upon movement of the rod in one direction, and move away from the seat to open the port, upon movement of the rod in the opposite direction. Also, the means for urging the rod to move in a direction to open the port comprises a surface area on the rod which is responsive to the pressure of fuel in the cavity, the diesel fuel being supplied through a first passageway formed within the body to connect its exterior with the cavity near the valve seat, and the alternative fuel being supplied through a second passageway formed within the body to connect its exterior with the cavity at a location more remote from the seat so that such fuel may be supplied to the cavity without disturbing the column of diesel fuel adjacent the injection port.

In the drawings wherein like reference characters are used throughout to designate like parts:

FIG. 1 is a diagrammatic illustration, partly in section, of a four cylinder diesel engine having a system constructed in accordance with the present invention for injecting a combination of diesel fuel and alternative fuel into the combustion chamber of each cylinder of the engine through a single injector connecting with each such chamber;

FIG. 2 is an enlarged longitudinal sectional view of one of the injectors; and FIG. 3 is another enlarged sectional view showing the details of the check valve controlled outlet from one of the pump chambers of the pump for injecting alternative fuel into each injector cavity; and FIG. 4 is another enlarged detailed sectional view of the pump chamber outlet having an alternative form of check valve installed therein.

With reference now to the details of the above described drawing, FIG. 1 shows a four cylinder engine 10 having four fuel injectors 15 connected to the head 14 thereof. As shown in FIG. 2, each cylinder 11 has a piston 12 reciprocable therein to form a combustion chamber 13 at the upper end of the piston beneath the cylinder head 14. Although only one such chamber is shown, it will be understood that each of the other chambers is of similar construction, and further that although the piston thereof is shown as it approaches high center position, the others will be at different levels within their cylinders so as to properly time the combustions in the chambers.

Each injector is supplied with alternative fuel from an injection pump 16 and with diesel fuel from an injection pump 17, the pistons within each pump chamber being driven by a suitable crankshaft so that the injection of fuel into the combustion chambers of the injectors is properly timed with respect to the movement of the piston within each pump cylinder. More particularly, the pump 16 has four pump chambers connecting with the injector cavity through supply conduits 18, and the pump 17 has four pump chambers connecting with such cavity through supply conduits 19.

As shown in FIG. 3, the supply of alternative fuel from each pump chamber 16A to its supply conduit 18 leading to each injector is controlled by means of a check valve 16B which normally closes the outlet from the chamber to prevent back flow, but which is adapted to open in response to pump pressure. Similar valves may of course be disposed within the outlets from the pump chambers of the diesel fuel pump 17 for normally preventing back flow of diesel fuel. As previously mentioned, however, diesel fuel may instead be supplied to each injector from a source at a relatively low pressure, and thus as a steady source of supply.

As shown in FIG. 2, each injector comprises a body 20 having an elongate cavity 21 therein and a port 22 in the lower end of the cavity. With the lower end of the body connected to the cylinder head 14, the port opens into the center of the combustion chamber. A seat 23 is formed in the cavity about the port, and a needle valve member 24 is shiftable within the cavity between the lower position shown in FIG. 2, in which it engages the seat to close the port, and an upper position (not shown) in which it is spaced above the seat to open the port.

Each valve member 24 is carried on the lower end of a rod 25 which is reduced in cross section and extends coaxially within the cavity 21 to provide an annular space about it. The rod has an upper enlarged end 26 which is guideably and sealably reciprocable within a bore 27 of the body which connects the cavity with a housing 28 in the upper end of the body in which a coil spring 29 is contained to urge the needle valve to closed position.

A first passageway 30 is formed in a lateral projection of the body to connect one of the supply conduits 18 leading from the alternative fuel injection pump with the upper end of the cavity just below the enlarged portion 26 of the rod. A second passageway is formed in the body to connect one of the supply conduits 19 leading from the diesel fuel injection pump with the cavity 21 near the valve seat 23. As shown, passageway includes a port 32 within a lateral projection of the injection body beneath the projection in which passageway 30 is formed, and a vertical passage 32A in the body connecting the port with the cavity. Thus, intermediate injection events, the lower end of the cavity may be filled with a column DF of diesel oil beneath a column AF of alternative fuel.

An annular area 33 at the lower end of the enlarged portion 26 of the rod provides a surface which is responsive to fuel pressure within the annular space of the cavity to urge the rod in an upward direction, and thus urge the needle valve member to a position opening the port. This force due to fuel pressure is opposed by the force of spring 29 compressed between the closed upper end of the spring housing and a collar 35 which bears upon the upper end of the enlarged portion of the rod. The closed end of the spring housing is formed on the lower end of end of a nut 36 which is threadedly received in the upper end of the main portion of the injector body so as to permit the force of the spring to be adjusted.

Opening movement of the valve member 24 in an upward direction is limited by engagement the enlarged portion 26 of the rod 25 with a stop on the lower end of a stem 37 threadedly connected to nut 36. Obviously, the stem may be adjusted axially of the cavity of the injector body to adjust the permissible stroke of the valve member, or, if desired, hold it in closed position.

As shown in the detailed view of FIG. 3, each pump chamber 16A of the alternate fuel injection pump has a cylinder 40 with a piston 41 reciprocable therein. A fitting 42 connected to the outer end of the cylinder provides an outlet 43 from the chamber which is surrounded by a seat 44 for the check valve 16B, and the outlet is in turn connected to a supply conduit 18 leading to one of the injectors to supply alternate fuel thereto. When engaged with seat 44, as shown, check valve 16B closes the outlet, and, when raised from the seat, opens the outlet to permit alternative fuel to be pumped into one of the injectors. As shown, the lower side of the head of the check valve 16A is conically shaped to form line contact with the seat 44 in its closed position, and is urged toward the closed position by means of a coil spring 45 acting downwardly on its upper side.

As shown in FIG. 3, a port 46 extends through the check valve 16B to connect the pump chamber 40 with the supply conduit. This port is normally closed by a ball 48 which is spring pressed toward a seat 47 about the port, so that it will permit alternative fuel to bypass the check valve as it is forced through supply conduit, during the supply of diesel fuel to the injection cavity prior to the supply of alternative fuel thereto. Thus, the force holding check valve 48 closed is less than that which holds the needle valve closed, so that the column DF of diesel fuel may be replaced without prematurely opening the injection port. Obviously, a bypass could instead be provided by other means such as a restricted orifice through check valve 15A.

As previously described, the outlet from each of the chambers of the pump 17 would be controlled by a check valve similar to that shown in FIG. 3, but without any provision for bypass. However, in the alternative arrangement previously described, a constant flow of a small volume of diesel fuel supplied to conduit 19 from a source thereof at constant pressure, and back flow to the source from the injector could be prevented by a check valve (not shown) mounted with port 32 of the injector body.

In any event, diesel fuel is supplied to each injector cavity at such a pressure that the force it produces on the pressure responsive area 33 of the needle valve actuating rod is insufficient to raise the needle valve from its closed position. When the diesel fuel is supplied from the injection pump 17, such injection takes place prior to the injection of the alternative fuel from the pump so that the lower end of the injector cavity is filled with diesel fuel beneath the alternative fuel filling the remainder of the cavity. Of course, it will be understood that the conduits leading to the injector cavities have been primed to fill them and thus maintain the fuels in the injector cavity under pressure.

As previously described, the alternative fuel is supplied from its pump 16 at a relatively high pressure which provides a force acting on the surface 33 which is sufficient to open the injection port, whereby a plume of the diesel fuel and alternative fuel is injected into the combustion chamber just prior to movement of the piston in the chamber into high center position. As also described, the tip of this plume is diesel fuel, which is ignited by compression in the chamber, and whose ignition in turn ignites the alternative fuel. When pump pressure is relieved, the check valve 16B returns to seated position, and the needle valve 24 in the injector is lowered back to its seated position. After a predetermined interval, the diesel fuel injection pump 17 will again supply diesel fuel to the lower end of the injector cavity so as to prepare the injector for the next injection event, the alternative fuel which is displaced by this added charge of diesel fuel being permitted to back flow into the alternative fuel injection pump.

It has been found possible, with a system of this type, to successfully operate the diesel engine with as much as 95% by weight of alternative fuel, although substantially larger percentages of alternative fuel may be found to degrade the diesel fuel to such an extent as to significantly delay ignition. These results have, in my opinion, been made possible by the substantial degree of separation between the diesel fuel and the alternative fuel in the injector cavity prior to the injection event. That is, the two fuels have not found to mix to such an extent as to reduce the quality of the ignition, as was found in the case of other systems of this type wherein the two fuels were premixed prior to injection into the combustion chamber. I further have reason to believe that the interval of time between the injection of the diesel fuel and the alternative fuel is not critical in preventing mixing, especially since the interval between injection events is in any event of very short duration. Still further, it is possible to increase the percentage of diesel fuel significantly without causing the injection port to be prematurely opened, and, even if such problems were encountered, the injection rate of the diesel fuel pump could be adjusted. Also, of course, one would not expect a problem of this type if the diesel fuel were supplied from a constant pressure source, as previously described, rather than from an injection pump.

If it is nevertheless found that there is a tendency for the diesel fuel and alternative fuel to premix, either prior to or during the injection event, due, for example, to retardation by air drag of the diesel fuel as it passes through the port, the system may be modified to cause a small amount of fuel consisting almost entirely of diesel fuel to be preinjected into the combustion chamber prior to the main injection of a plume of diesel and alternative fuels. For this purpose, the check valves which control the supply of alternative fuel may be modified as shown for example by check valve 16B' in FIG. 4 wherein a valve head 50 at the upper end of the valve fits closely within a cylindrical extension 51 of the upper end of the pump chamber outlet. When lifted, the check valve permits alternative fuel to be initially supplied at a higher than normal rate to cause the injection port to open for a very short interval, and then close for a brief interval due to a sudden decrease in the rate of supply of alternative fuel for a relatively short duration, following which a plume of both diesel fuel and alternative fuel is injected, as described. In other respects, including a ball valve member 48 for controlling bypass passageway 46, the valve of FIG. 4 is similar to the valve of FIG. 3.

As also previously described, the injection of both fuels into the center of the combustion chamber produces a better fuel distribution pattern than is possible in the event that one fuel is injected through one injector and the other fuel through another injector, thereby necessarily causing one of the injections to take place eccentrically of the center of the combustion chamber.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations.

This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An improved system for operating a diesel engine with a combination of diesel fuel and alternative fuel having a low cetane number, wherein the engine includes at least one cylinder having a piston therein to form a combustion chamber at one end of the cylinder, comprising a single fuel injector adapted to be connected with the combustion chamber of said cylinder of the engine, said injector including a cavity therein having a port through which fuel may be injected into the combustion chamber and a valve seat about the port, a valve member shiftable between one position on the seat to close the port and another position spaced from the seat to open the port, means which is responsive to the pressure of fuel in the cavity to urge said valve member to open position, means urging the valve member toward closed postition with a force which is independent of such fuel pressure, means for supplying diesel fuel to the cavity of said injector at a location near the valve seat, means for supplying alternative fuel to the cavity of said injector the diesel fuel being supplied at a relatively low pressure which does not move the valve member to open position, the alternative fuel being supplied at a relatively high pressure which is sufficient to move the valve member to open position at intervals just prior to the movement of the piston of the cylinder of the chamber into which the fuel is to be injected into high center position during its compression stroke, and said fuel supplying means including means to prevent the back flow of fuel therein, and thus maintain the cavity filled with fuel, except when alternative fuel is displaced within the cavity by the supply thereto of diesel fuel, whereby a plume of both fuels having the diesel fuel at its tip is injected into said chamber to enable the diesel fuel to be ignited by the compression in the chamber and the alternative fuel to be ignited by the diesel fuel.

2. A system of the character defined in claim 1, wherein the means for supplying alternative fuel to the cavity of said injector includes an injection pump having a chamber, a conduit connecting the pump chamber with the injector cavity, a check valve in the conduit which is normally closed but adapted to be opened by pump pressure at said relatively high pressure, and means through which alternative fuel may bypass the check valve.

3. A system of the character defined in claim 2, wherein the means through which alternative fuel may bypass the check valve includes a passage through the check valve and another check valve in the passage which is normally closed but adapted to open in response to the displaced fuel.

4. A system of the character defined in claim 2, wherein the means for supplying diesel fuel to the cavity of said injector includes an injection pump having a chamber, a conduit connecting the pump chamber with the injector cavity, and a check valve in the conduit which is normally closed but adapted to be opened by pump pressure at intervals prior to the supply of alternative fuel.

5. A system of the character defined in claim 1, wherein the diesel fuel is supplied from a source at a relatively constant pressure, a conduit connects the source with the injector cavity, and a check valve prevents back flow through the conduit.

6. A system of the character defined in claim 1, wherein the means for supplying the alternative fuel to the cavity of said injector includes means for causing a small volume of fuel consisting almost entirely of diesel fuel to be injected into the combustion chamber prior to the main injection of the plume of both fuels.

* * * * *